United States Patent [19]

Sakaguchi

[11] Patent Number: 4,694,886

[45] Date of Patent: Sep. 22, 1987

[54] HORIZONTAL CONTINUOUS CASTING APPARATUS

[75] Inventor: Haruo Sakaguchi, Osaka, Japan

[73] Assignee: Hitachi Zosen Corporation, Osaka, Japan

[21] Appl. No.: 856,820

[22] Filed: Apr. 28, 1986

[30] Foreign Application Priority Data

May 28, 1985 [JP] Japan ..... 60-114861

[51] Int. Cl.[4] ..... B22D 11/04

[52] U.S. Cl. ..... 164/416; 164/440

[58] Field of Search ..... 164/416, 478, 440, 490

[56] References Cited

U.S. PATENT DOCUMENTS 3,045,299 7/1962 Steigerwald ..... 164/416 X 3,566,954 3/1971 Gamble ..... 164/440

4,434,839 3/1984 Vogel ..... 164/440 X

FOREIGN PATENT DOCUMENTS 231740 5/1969 U.S.S.R. ..... 164/416

*Primary Examiner*—Kuang Y. Lin

*Attorney, Agent, or Firm*—Joseph W. Farley

[57] ABSTRACT

An horizontal continuous casting apparatus comprising a tundish 3 for receiving molten metal 32, horizontally reciprocally movable oscillating nozzle 12 communicating with a nozzle opening 7*a* of the tundish 3, a mold 24 into which one end of the nozzle 12 is slidably inserted, and a vibrator 22 for horizontally vibrating the nozzle 12.

12 Claims, 18 Drawing Figures

HORIZONTAL CONTINUOUS CASTING APPARATUS

FIELD OF THE INVENTION

The present invention relates to a horizontal continuous casting apparatus, and more specifically to an improved casting machine for continuously producing a metal bar or strip of high quality.

BACKGROUND OF THE INVENTION

It has been established in horizontal continuous casting that a casting is intermittently drawn to allow for the shrinkage thereof upon cooling.

As shown in FIGS. 8 and 9, a typical existing horizontal continuous casting equipment comprises a tundish 50 for receiving molten metal 51. The molten metal 51 is fed through a tundish nozzle 52 and a breakring 53 into a copper mold 54 cooled by a water-cooling jacket 55 and intermittently drawn out as a casting 56 under solidification by an intermittent drawing device (not shown) as indicated by the arrow A. Indicated at 56a is a solidified shell.

In such a casting apparatus, the intermittent withdrawal by the drawing device of the casting 56 is conducted according to the drawing mode shown in FIG. 10. More particularly, the casting is first drawn at a predetermined speed by a predetermined amount (line portion I). Next, after some retention time (line portion II) the casting is pushed back a predetermined length (line portion III). Finally, the casting is stopped (line portion IV) until the next withdrawal starts. These steps constitute one cycle of the intermittent drawing operation.

Now the phenomena which occur in the mold 54 during a single cycle of the drawing operation will be described with reference to FIGS. 11*a*–11*h*. FIG. 11*a* shows the state of the solid shell 56*a* just on the verge of starting the withdrawal. In this state, the trailing end surface 56*b* of the solid shell 56*a* addheres to the front end surface 53*a* of the breakring 53. Since even the most thin shell part has an enough thickness, the shell end surface 56*b* can be separated from the ring end surface 53*a* by subsequent withdrawal without tearing at an intermediate portion of the solid shell 56*a*. As a result, the molten metal flows into the gap between the shell end surface 56*b* and the ring end surface 53*a* to form a secondary solidified shell 56*c* which is extremely thin at the middle thereof and thick adjacent both of the end surfaces 53*a* and 56*b* (FIG. 11*b*). The secondary shell 56*c* grows in length as the parent (primary) shell 56*a* advances. The secondary shell 56*c* cannot strongly bond to the end surface (actually interface) 56*b* of the parent shell 56*a* since the parent shell end surface 56*b* has already crystalized to an increased extent by the previous contact with the breaking end surface 53*a* and thus differs in crystalline structure from the secondary shell 56*c*. This interface 56*b* is called "cycle mark" by those skilled in the art and is known to cause subsequent crack formation. The secondary shell 56*c* provides at the position contacting the breakring end surface 53*a* a new end surface 56*d* which will become another cycle mark later.

The length growth speed of the secondary shell 56*c* is generally smaller than the advancing speed (drawing speed) of the parent shell 56*a*. Accordingly, further advance of the parent shell 56*a* from the position shown in FIG. 11*b* ultimately results in the breakage of the secondary shell 56*c* at the thin middle portion thereof to form divided secondary shells 56*c*' (FIG. 11*c*). The molten metal immediately flows into the gap between both of the divided secondary shells 56*c*' to form a tertiary shell 56*e* (FIG. 11*d*).

In the same way, further advance of the parent shell 56*a* from the position shown in FIG. 11*d* causes the tertiary shell 56*e* to break into divided tertiary shells 56*e*' (FIG. 11*e*) and to thereby form a fourth shell 56*f* between both of the divided tertiary shells 56*e*' (FIG. 11*f*).

One cycle of the casting drawing operation is completed by the above described steps. The shell crystalline structure changes discontinuously across the interfaces between the shell segments 56*c*', 56*e*', 56*f* formed during the processes illustrated in FIGS. 11*c* to 11*f*. Though being not so serious as the aforementioned cycle mark, these interfaces constitute defects called "tear marks" since they lead to subsequent formation of depressions and wrinkles. Thus, the tear marks together with the cycle marks deteriorate the quality of the casting.

The shell state after the push-back stroke is illustrated in FIG. 11*g* in which all shell segments formed between the parent shell 56 and the breaking 53 are generally represented as one piece by reference numeral 56*a*' for convenience although the tear marks are actually present as shown in FIG. 11*f*. As will be seen from FIG. 11*g*, after the push-back action the interposed shell 56*a*' has increased in thickness in correspondence with the amount of the push-back stroke and the degree of crystalization (solidification) of the molten metal during the push-back period.

In the subsequent pause period, further crystallization of the molten metal allows the interventing shell 56*a*' to grow to such a thickness (FIG. 11*h*) that the intervening shell 56*a*' can withstand the tensile force required to separate the now shell end face 56*d* from the breakring end face 53*a* upon withdrawal of the next drawing cycle. This state is substantially identical to the state shown in FIG. 11*a*.

By repeating the above described intermittent drawing cycle (drawing, push-back and pause) a casting is generally continuously produced, and in so doing a multiplicity of cycle marks (one for each cycle) and tear marks are formed on the opposite surfaces of the casting 56 (FIG. 8) as hereinbefore described.

One way to avoid defects in crystal structure caused by cycle marks and tear marks for improved casting quality is to increase the cycle speed of the drawing operation. It is for the following reason that high cycle intermittent drawing operation eliminates crystal structure defects associated with cycle marks. In high cycle intermittent drawing operation, the parent shell end face 56*b* contacts the breakring end face 53*a* for a reduced time, so that crystalization at the shell end face 56*b* proceeds to a decreased extent. As a result, discontinuity in shell crystal structure across the interface 56*b* between the parent shell 56*a* and the secondary shell 56*c* is not so serious as to render the cycle mark (which per se does not disappear) defective. Further, since high cycle intermittent drawing leads to a shorter withdrawal stroke, tearing of the secondary shell 56*c*, i.e., formation of tear marks, is unlikely to occur.

In the case of producing a casting having a large cross section, however, the large weight of the casting requires an increased energy for intermittent withdrawal.

In addition, it is naturally required to install behind the intermittent drawing device a cutting machine for cutting the casting at constant spacing, the mass of the cutter is added to the casting through the blade of the cutter engaging the casting during cutting operation. As a result, it is required to design the drawing machine in consideration of the inertia attributable to the combined mass of the casting per se and the cutting machine. Thus, in case a casting of a large thickness is desired, limitations are imposed on realizing high cycle intermittent drawing operation to ensure sufficiently improved product quality.

Instead of employing an intermittent drawing machine, Published Unexamined Japanese Patent Application No. 54-82328 discloses a continuous casting method in which a tundish provided fixedly with a mold and a breakring is horizontally vibrated by a vibrator while a casting is continuously withdrawn at a constant speed by a continuous drawing device (The tundish in this case is similar to the one illustrated in FIG. 8 but additionally has casters to impart horizontal movability.). According to this method, when the tundish is moved by the vibrator in a direction opposite to the casting drawing direction, the net (relative) speed of the casting withdrawal from the mold becomes higher than the drawing speed afforded solely by the continuous drawing device. On the other hand, when the tundish is moved in the casting drawing direction, the mold moves faster than the casting being moved by the drawing device, so that the casting is pushed back relative to the mold. Thus, the tundish vibrating type casting machine of this prior art is also accompanied by cycle marks and tear marks as in the intermittent drawing type casting machine described hereinbefore, and the problems attendant with the cycle marks and the tear marks can be similarly eliminated or relieved by increasing the frequency of the oscillating tundish.

However, the weight of the tundish receiving molten metal is so heavy that it is extremely difficult to vibrate the tundish at a high frequency. Further, weight variation due to a decrease in the surface level of the molten metal within the tundish makes it difficult to suitably control the amplitude and frequency of the oscillating tundish.

SUMMARY OF THE INVENTION

An object of the present invention, which has improved the conventional tundish vibrating type casting apparatus, is to provide an oscillatory horizontal continuous casting apparatus capable of eliminating or alleviating product defects due to cycle marks and tear marks.

To accomplish this object, the present invention provides a horizontal continuous casting apparatus comprising: a tundish for receiving molten metal, the tundish having a discharge opening; oscillating nozzle means communicating with the discharge opening of the tundish and adapted to move horizontally reciprocally; mold means into which one end of the nozzle means is slidably inserted; and vibrator means for horizontally oscillating the oscillating nozzle means.

In accordance with the above construction, the lightness of the oscillating nozzle means corresponding to a breakring permits vibrations thereof at high frequency by the vibrating means so that deterioration in product quality due to cycle marks and tear marks can be prevented. Further, since the weight of the nozzle means does not change during the casting operation, its oscillating stroke and frequency can be easily and reliably controlled.

Numerous features and effects of the present invention will be readily understood from the description of embodiments given below with reference to the accompanying drawings.

DETAILED DESCRIPTION

Figure 1:
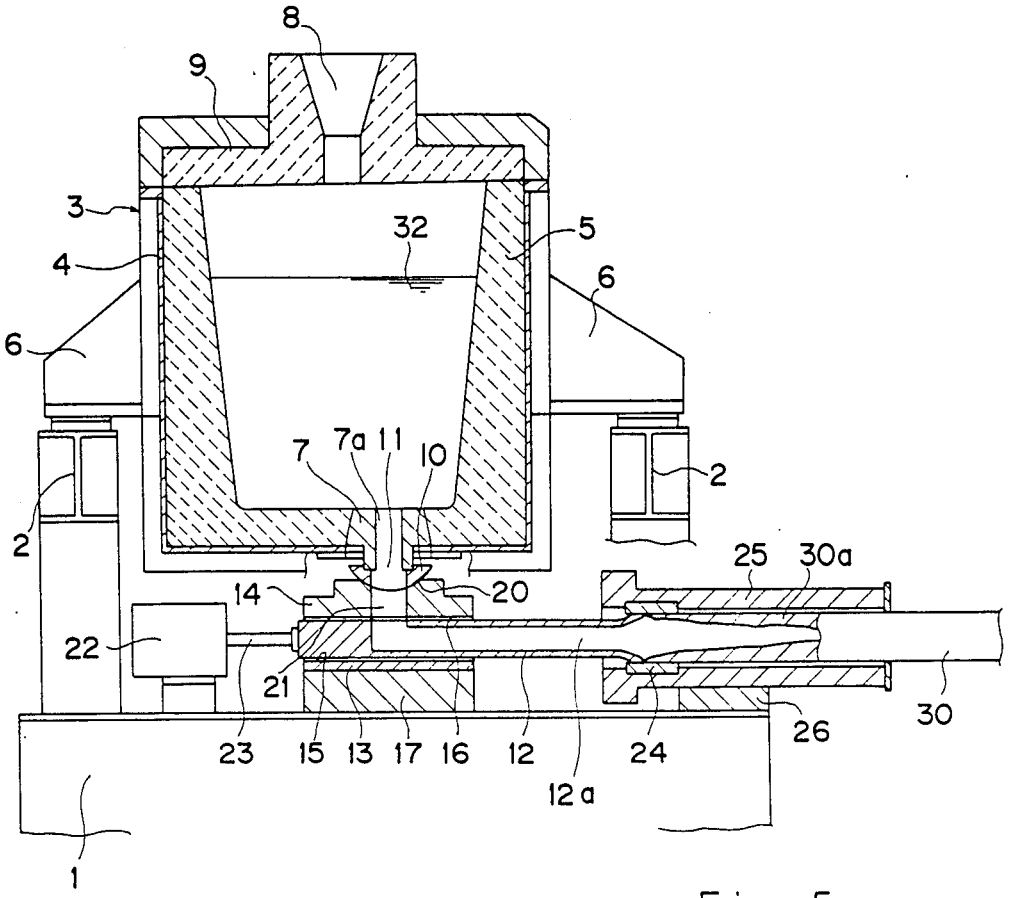
FIG. 1 is a sectional side elevation of a horizontal continuous casting apparatus embodying the present invention.

Referring now to FIG. 1, numeral 1 represents a casting base which may be provided for instance in the form of a carriage movable between the illustrated casting position and an unillustrated preheating position. By using two such movable carriages it is possible to conduct casting on one carriage while conducting preheating on the other carriage, thereby reducing the time interval between batches of the casting operation.

The casting base 1 is provided thereon with upright support posts 2 which support a tundish 3 above the base 1 through brackets 6. The tundish 3 comprises an outer base 4 internally lined with refractory bricks 5. The upper end of the tundish 3 is closed by a cover 9 having a supply inlet 8 at the center thereof. Embedded in the bottom wall of the tundish 3 is a tundish nozzle 7 having a nozzle opening 7*a*. The support posts 2 may be provided with a weight meter for measuring the quantity of molten metal 32 in the tundish 3.

The projecting lower end of the tundish nozzle 7 is fitted in a partial spherical connector 10 of a refractory material having a connector hole 11 with a heat resistant packing (not shown) interposed between the nozzle 7 and the connector 10.

Figure 2:
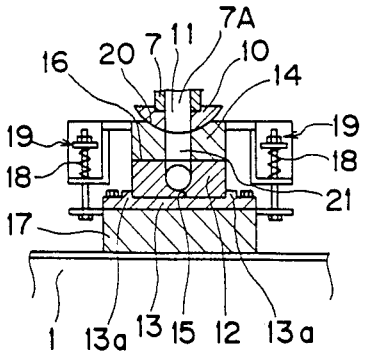
FIG. 2 is a sectional front view representing an oscillating nozzle of the casting apparatus and its guide means.

Further below the connector 10 is disposed a horizontal oscillating nozzle 12 of a refractory material having an L-shaped interior passage 12*a*. The oscillating nozzle 12 is longitudinally slidably interposed between a horizontal lower slide guide 13 having a contact surface 15 and a horizontal upper slide guide 14 having a contact surface 16. As best shown in FIG. 2, the lower slide guide 13 is mounted on a support 17 fixed to the casting base 1 and has on the upper surface 15 thereof side rails 13*a* for preventing the oscillating nozzle 12 from lateral displacement. The upper slide guide 14 is connected to the lower slide guide 13 by means of a presser jig 19 having downwardly acting springs 18 which press the upper slide guide 14 against the oscillating nozzle 12. On the upper surface of the upper slide guide 14 is formed a partial spherical concave seat 20 in which the lower convex surface of the connector 10 is snugly fitted. Thus, the tundish 3 can be readily adjusted in position relative to the upper slide guide 14 as well as horizontality. The upper slide 14 has a communication hole 21 communicating the connector hole 11 of the connector 10 and the interior passage 12*a* of the oscillating nozzle 12.

The oscillating nozzle 12 is connected at the rear end thereof to a vibrator 22 through a connector rod 23 for horizontal reciprocal movement (oscillation). On the other hand, the open front end of the nozzle 12 is slidably guided by the inner surface of a mold 24.

Figure 3:
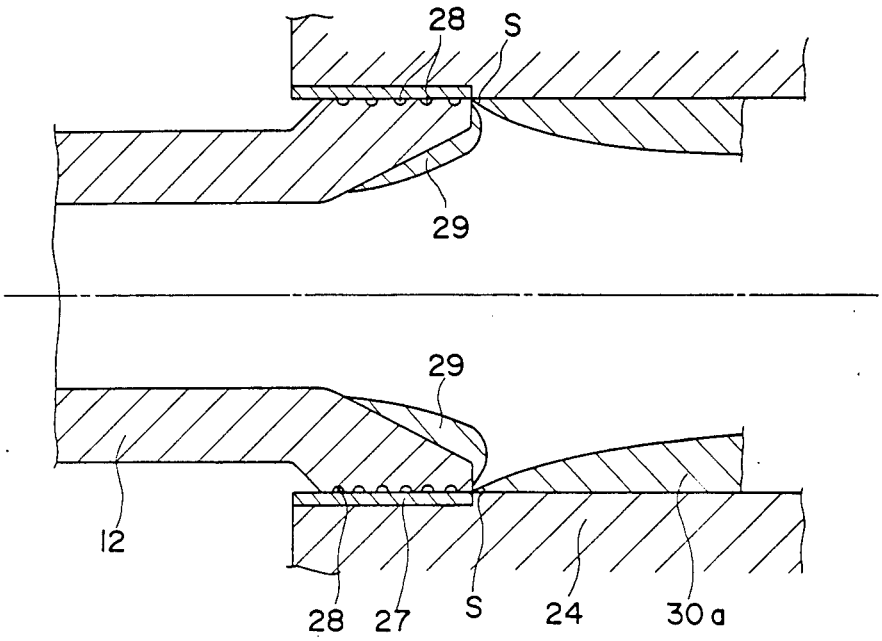
FIG. 3 is an enlarged fragmentary sectional side view illustrating the front end portion of the nozzle and a mold.

The mold 24 is arranged in a water cooling jacket 25 fixed to the casting base 1 through a mold support 26. As shown in FIG. 3, a part of the inner surface of the mold 24 for slidable contact with the front end of the oscillating nozzle is provided with a slide lining 27 made of a material such as a ceramic material which is excellent in high temperature strength and low in affinity to the molten metal 32 and has a high erosion resistance against the molten metal 32. The front end outer surface of the oscillating nozzle 12 is formed with insulating grooves 28 to maintain the nozzle front end at maximally high temperature by detering cooling influences from the mold 24 and to thereby prevent a nozzle shell 29 from growing to an unacceptable thickness. The minute clearance between the front end of the nozzle 12 and the slide lining 27 is up to 0.05 mm so that the molten metal could not leak out from the interior of the mold 24.

Figure 4:
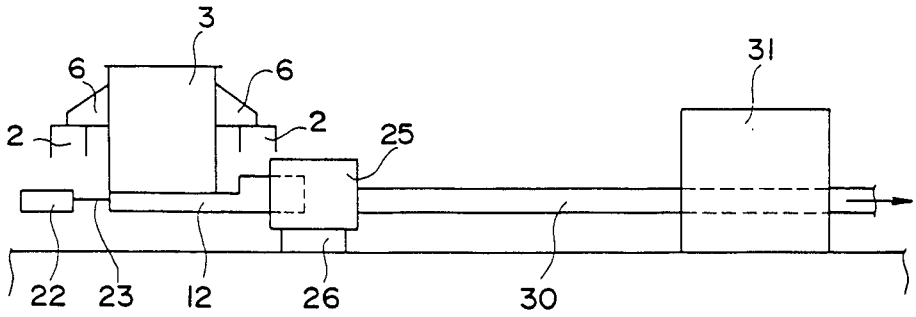
FIG. 4 is a side view schematically showing the general construction of the casting apparatus including a drawing device.

With the horizontal continuous casting apparatus of the above construction, the molten metal 32 in the tundish 3 flows through the nozzle opening 7*a*, the connector hole 11 and the communication hole 21 into the interior passage 12*a* of the oscillating nozzle 12. Upon entry into the mold 24 cooled by the jacket 25, the molten metal 32 starts solidifying to form a casting shell 30*a* and is finally drawn as a casting (strand) 30 by a continuous drawing device 31 (FIG. 4). During such a casting operation the oscillating nozzle 12 is vibrated at high frequency by the vibrator 22 through the connector rod 23. Such high frequency vibration of the nozzle 12 prevents the trailing edge S of the casting shell 30*a* from adhering to the front end of the nozzle 12 (FIG. 3), so that neither cycle marks nor tear marks are formed on the casting 30. Further, even if the trailing edge S of the casting sticks to the front end of the nozzle 12, the cycle marks end tear marks formed under the high frequency vibration of the nozzle 12 do not lead to quality deterioration for the reason set forth in connection with the prior art. Still further, the nozzle shell 29 formed on the front end inner surface of the nozzle 12 remains thin due to the heat shielding effect of the grooves 28 and the high frequency vibration of the nozzle 12.

Figure 5:
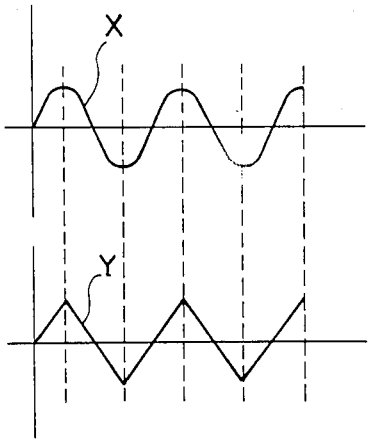
FIG. 5 is a graph showing two optional vibrating modes of the nozzle.

The product quality improves with increasing oscillation frequency and decreasing oscillation stroke of the nozzle 12. The oscillatory wave form generated by the vibrator 22 may be a sine curve as indicated by line X in FIG. 5, but such a sine curve wave form poses a limitation of realizing high frequency oscillation and causes a problem in service life when using a rotary mechanical vibrator. Further, with the sine curve oscillation, the maximum moving speed of the vibrator is given at 90° and 270°, whereas the moving speed reduces to zero at 0° and 180°, consequently resulting in unevenness in product quality. It is thus preferable to use a vibrator of the linearly driven type such as a servo cylinder driven vibrator to obtain saw-tooth wave form oscillation as indicated by line Y in FIG. 5.

When needed, the tundish 3 may be lifted up and transferred for required treatment and repair, and subsequently reused. In case the casting 30 has a large width, a plurality of oscillating nozzles may be arranged as spaced widthwise of the casting and synchronously vibrated by a corresponding number of vibrators.

Figure 6:
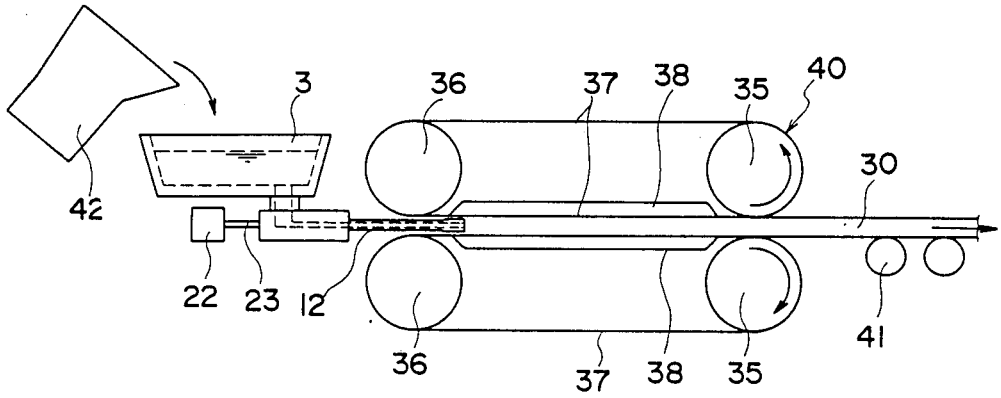
FIG. 6 is a schematic side elevation of another horizontal continuous casting apparatus embodying the present invention.
Figure 7:
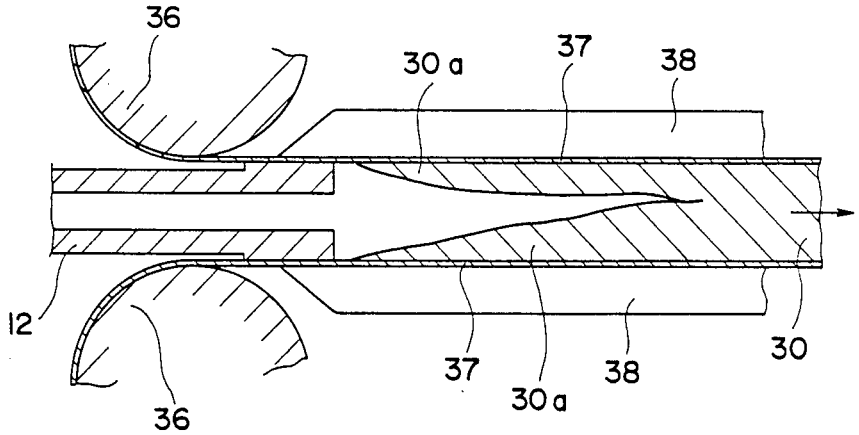
FIG. 7 is an enlarged fragmentary sectional side view representing the front end of an oscillating nozzle and a movable mold incorporated into the casting apparatus of FIG. 6.
Figure 8:
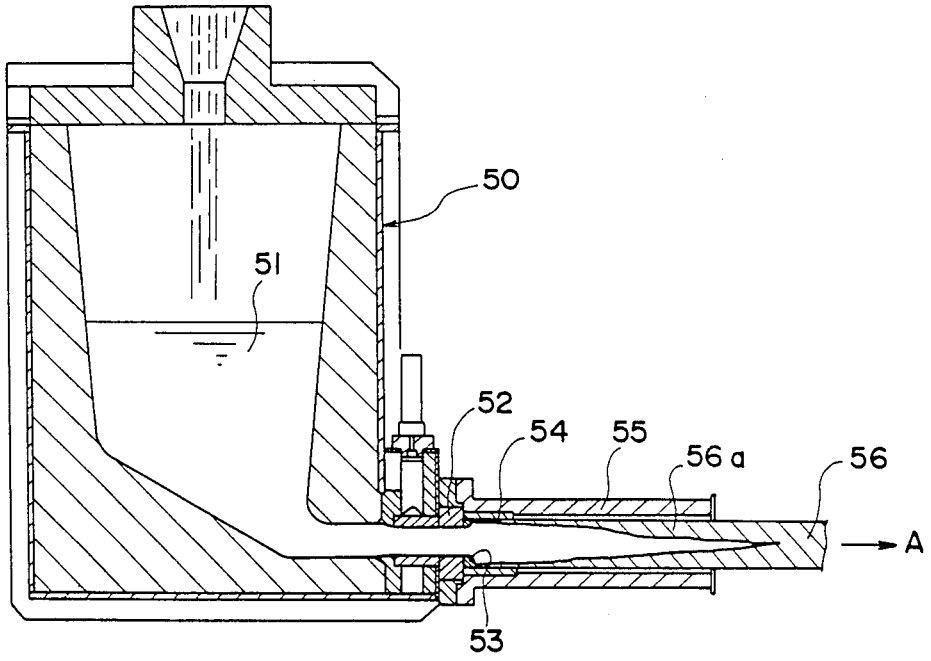
Fig. 8 Prior Art
FIG. 8 is a sectional side elevation representing a conventional horizontal continuous casting apparatus.
Figure 9:
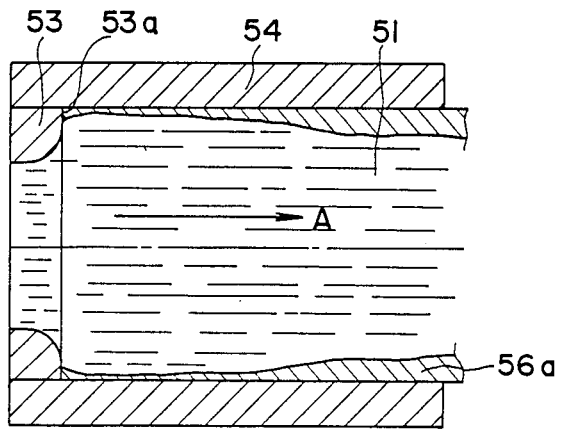
Fig. 9 Prior Art
FIG. 9 is an enlarged fragmentary sectional side view illustrating the principal portion of the conventional apparatus.
Figure 10:
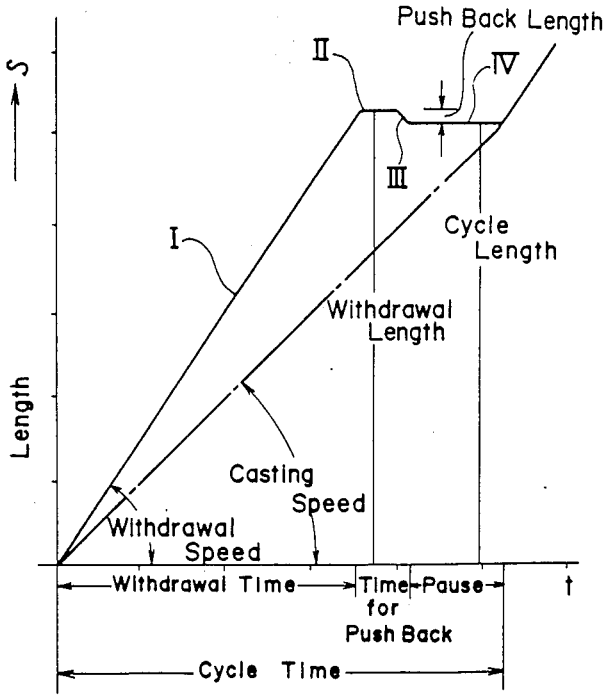
FIG. 10 is a graph representing a casting drawing mode of the conventional apparatus.
Figure 11A:
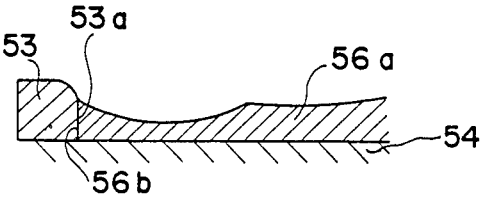
FIGS. 11*a* to 11*h* are views illustrating the process of cycle and tear mark formation.
Figure 11B:
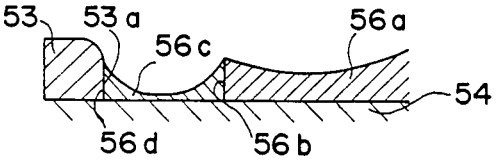
Figure 11C:
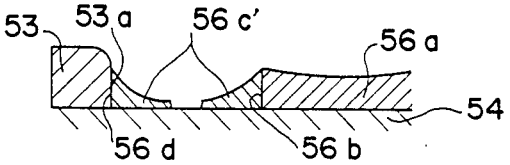
Figure 11D:
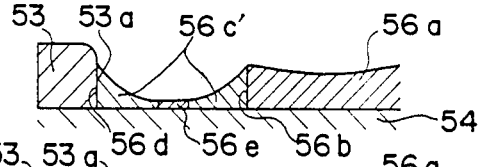
Figure 11E:
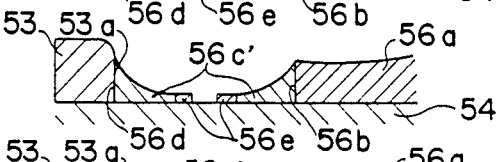
Figure 11F:
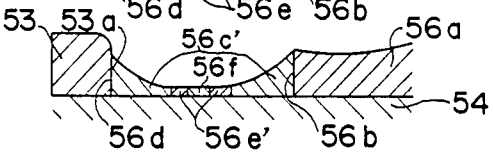
Figure 11G:
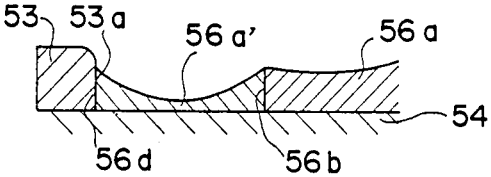
Figure 11H:
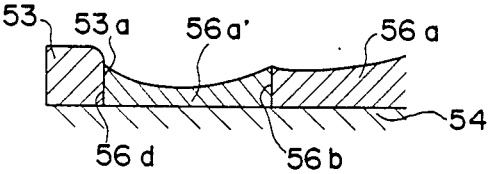

FIGS. 6 and 7 schematically show a casting apparatus suitable for producing a thin metallic strip, as opposed to the apparatus of FIGS. 1 to 4 which is adapted for producing a billet or like metallic bar or rod of rectangular or circular cross section. The reference numerals used in FIGS. 1 to 4 are also used in FIGS. 6 and 7 to indicate elements which are identical or substantially identical in function to those elements shown in FIGS. 1 to 4.

Referring to FIGS. 6 and 7, a mold 40 comprises a pair of opposed drive rollers 35 disposed on both sides of the path of withdrawal of a casting 30, a pair of opposed free rollers 36 similarly disposed on both sides of the casting withdrawal path, and an endless belt 37 connecting between each of the drive rollers 35 and one of the free rollers 36 on the corresponding side. A cooling box 38 is provided on each side of the casting withdrawal path to cool the endless belt 37 in contact with the casting 30. Though not illustrated, the mold 40 further comprises a pair of lateral mold plates spaced widthwise of the casting 30 between both belts 37 to define the width of the casting 30. Indicated at 41 are guide rolls defining the casting withdrawal path, and at 42 a ladle for supplying the molten metal into the tundish 3.

The casting apparatus of FIGS. 6 and 7 is otherwise the same as the one shown in FIGS. 1 to 4. As is easily appreciated, the mold 40 per se serves also as a drawing device, so that there is not necessity for the provision of a separate drawing device.

What is claimed is:

1. A horizontal continuous casting apparatus comprising: a tundish for receiving molten metal, the tundish having a discharge opening; oscillating nozzle means adapted to move horizontally reciprocally and having an interior molten metal passage; upper and lower slide guides for guiding the nozzle means to move horizontally reciprocally, one end of the oscillating nozzle means being interposed between said slide guides, and the upper slide guide having a communication hole connecting the discharge opening of the tundish with the interior passage of the oscillating nozzle means; mold means into which the other end of the oscillating nozzle means is slidably inserted; and vibrator means for horizontally oscillating the oscillating nozzle means relative to said tundish and to said mold means.

2. An apparatus as defined in claim 1, wherein the mold means comprises a pair of rollers arranged on each side of an extension line passing longitudinally of the oscillating nozzle means and spaced along said extension line, and an endless belt connecting each pair of rollers, the pair of rollers on one side of the extension line being opposed respectively to the pair of rollers on the other side of the extension line.

3. An apparatus as defined in claim 1, wherein the lower slide guide is provided with rail means extending longitudinally of the nozzle means.

4. An apparatus as defined in claim 1, wherein the upper and lower slide guides are biased toward each other by resilient means.

5. An apparatus as defined in claim 1, wherein the upper slide guide is provided on the side thereof facing the tundish with a partial spherical concave seat positioned at the communication hole, the discharge opening of the tundish communicating with the communication hole of the upper slide guide through a partial spherical connector fitted in the concave seat and having a connector hole.

6. An apparatus as defined in claim 1, wherein the mold means is of the fixed type and provided internally with a slide lining for contact with said other end of the nozzle means, the lining being made of a material which is high in high temperature strength and low in affinity to the molten metal and has a high erosion resistance against the molten metal.

7. An apparatus as defined in claim 6, wherein the slide lining of the mold means is made of a ceramic material.

8. An apparatus as defined in claim 6, wherein the mold means is arranged in a water-cooling jacket.

9. An apparatus as defined in claim 1, wherein said other end of the oscillating nozzle means is externally provided with at least one heat insulation groove.

10. An apparatus as defined in claim 2 further comprising cooling means to cool each belt in near proximity to said extension line.

11. An apparatus as defined in claim 2, wherein one of each pair of rollers is a drive roller, and the other is a free roller.

12. A horizontal continuous casting apparatus comprising:

a tundish for receiving molten metal and having a discharge opening;

oscillatable nozzle means having an interior molten metal passage, said passage having an inlet end communicating with said discharge opening and having a discharge end;

guide means mounted below the tundish for slidably supporting the nozzle means for horizontal reciprocating movement;

mold means slidably receiving the discharge end portion of said nozzle means; and, vibrator means for horizontally oscillating said nozzle means relative to said tundish and to said mold means.

* * * * *

UNITED STATES PATENT AND TRADEMARK OFFICE

CERTIFICATE OF CORRECTION

PATENT NO. : 4,694,886

DATED : September 22, 1987

INVENTOR(S) : Haruo Sakaguchi

It is certified that error appears in the above—identified patent and that said Letters Patent is hereby corrected as shown below:

Column 2, line 26 "breaking" should read --breakring--

Column 5, line 37, correct spelling of deterring

Column 6, line 6, "of" should read --on-- line 50, "not" should read --no--.

Signed and Sealed this

Fifth Day of April, 1988

*Attest:*

*Attesting Officer*

DONALD J. QUIGG

*Commissioner of Patents and Trademarks*